US010125550B2

(12) United States Patent
Velvaluri et al.

(10) Patent No.: US 10,125,550 B2
(45) Date of Patent: Nov. 13, 2018

(54) ORIENTATION OF CUTTING ELEMENT AT FIRST RADIAL POSITION TO CUT CORE

(71) Applicant: Smith International, Inc., Houston, TX (US)

(72) Inventors: Suman Velvaluri, Houston, TX (US); Hemachandar Mada, Houston, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 482 days.

(21) Appl. No.: 14/482,992

(22) Filed: Sep. 10, 2014

(65) Prior Publication Data

US 2015/0068816 A1 Mar. 12, 2015

Related U.S. Application Data

(60) Provisional application No. 61/876,587, filed on Sep. 11, 2013.

(51) Int. Cl.
*E21B 10/43* (2006.01)
*E21B 10/02* (2006.01)

(52) U.S. Cl.
CPC ..... *E21B 10/43* (2013.01); *E21B 10/02* (2013.01)

(58) Field of Classification Search
CPC ..... E21B 10/02; E21B 10/43; E21B 10/485; E21B 25/10
See application file for complete search history.

(56) References Cited

U.S. PATENT DOCUMENTS 4,858,707 A * 8/1989 Jones ..... E21B 10/5673 175/431
4,907,662 A 3/1990 Deane et al.
5,443,565 A * 8/1995 Strange, Jr. ..... E21B 10/43 175/431
5,655,614 A * 8/1997 Azar ..... E21B 10/04 175/404
6,394,202 B2 5/2002 Truax et al.
(Continued)

FOREIGN PATENT DOCUMENTS

WO WO 2008149240 A2 * 12/2008 ..... E21B 10/485

OTHER PUBLICATIONS

International Search Report and Written Opinion issued in International application PCT/US2014/055078 dated Dec. 18, 2014, 12 pages.

(Continued)

*Primary Examiner* — Cathleen R Hutchins
*Assistant Examiner* — Ronald R Runyan

(57) ABSTRACT

A fixed cutter drill bit may include a bit body having a bit centerline a plurality of blades extending radially from the bit body, and a plurality of flow courses between the plurality of blades. Each of the plurality of blades is spaced a radial distance from the bit centerline to define a core-forming region. A plurality of cutting elements is disposed on the plurality of blades, and the plurality of cutting elements include at least one coring cutting element disposed on at least one of the plurality of blades. The at least one coring cutting element is the radially innermost cutting element on the plurality of blades, and a coring angle of the at least one coring cutting element is less than an inner cone angle thereof.

17 Claims, 15 Drawing Sheets

(56) References Cited

U.S. PATENT DOCUMENTS

| | | | | |
|---|---|---|---|---|
| 7,055,626 | B2 * | 6/2006 | Wells | E21B 10/48 175/393 |
| 7,703,559 | B2 | 4/2010 | Shen et al. | |
| 2006/0180356 | A1 | 8/2006 | Durairajan et al. | |
| 2006/0260845 | A1 | 11/2006 | Johnson | |
| 2007/0119625 | A1 * | 5/2007 | Brady | E21B 10/62 175/57 |
| 2009/0065263 | A1 | 3/2009 | Shen et al. | |
| 2010/0000800 | A1 * | 1/2010 | Chen | E21B 10/55 175/430 |
| 2010/0101870 | A1 | 4/2010 | Shamburger | |
| 2010/0133013 | A1 * | 6/2010 | Hahati | E21B 10/485 175/61 |
| 2010/0219001 | A1 | 9/2010 | Shen et al. | |
| 2010/0300673 | A1 | 12/2010 | Richert et al. | |
| 2011/0297454 | A1 | 12/2011 | Shen et al. | |
| 2012/0205163 | A1 | 8/2012 | Azar et al. | |
| 2012/0234610 | A1 * | 9/2012 | Azar | E21B 10/26 175/431 |
| 2012/0273280 | A1 | 11/2012 | Zhang et al. | |
| 2012/0273281 | A1 | 11/2012 | Burhan et al. | |
| 2013/0020134 | A1 | 1/2013 | Azar et al. | |
| 2013/0112485 | A1 | 5/2013 | Richert et al. | |
| 2013/0199857 | A1 | 8/2013 | Schwefe et al. | |
| 2013/0277120 | A1 | 10/2013 | Azar et al. | |
| 2014/0054094 | A1 | 2/2014 | Burhan et al. | |

OTHER PUBLICATIONS

International Preliminary Report on Patentability issued in International application PCT/US2014/055078 dated Mar. 24, 2016, 8 pages.

First Office Action and Search Report issued in corresponding Chinese patent application 201480059210.6 dated Dec. 30, 2016; 13 pages.

* cited by examiner

ORIENTATION OF CUTTING ELEMENT AT FIRST RADIAL POSITION TO CUT CORE

CROSS-REFERENCE TO RELATED APPLICATIONS

This application claims priority to U.S. Patent Application No. 61/876,587, filed on Sep. 11, 2013, which is herein incorporated by reference in its entirety.

BACKGROUND

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors such as the formation to be drilled.

The cutting elements disposed on the blades of a fixed cutter bit are typically formed of extremely hard materials. In a typical fixed cutter bit, each cutting element comprises an elongate and generally cylindrical tungsten carbide substrate that is received and secured in a pocket formed in the surface of one of the blades. The cutting elements typically include a hard cutting layer of polycrystalline diamond (PCD) or other superabrasive materials such as thermally stable diamond or polycrystalline cubic boron nitride. These cutting elements are designed to shear formations that range from soft to medium hard. For convenience, as used herein, reference to "PDC bit" or "PDC cutters" refers to a fixed cutter bit or cutting element employing a hard cutting layer of polycrystalline diamond or other superabrasive materials.

Referring to FIGS. 1 and 2, a conventional PDC bit 10 adapted for drilling through formations of rock to form a borehole is shown. PDC bit 10 generally includes a bit body 12, a shank 13, and a threaded connection or pin 14 for connecting the PDC bit 10 to a drill string (not shown) that is employed to rotate the bit in order to drill the borehole. Bit face 20 supports a cutting structure 15 and is formed on the end of the PDC bit 10 that is opposite pin end 16. PDC bit 10 further includes a central axis 11 about which PDC bit 10 rotates in the cutting direction represented by arrow 18.

Cutting structure 15 is provided on face 20 of PDC bit 10. Cutting structure 15 includes a plurality of angularly spaced-apart primary blades 31, 32, 33, and secondary blades 34, 35, 36, each of which extends from bit face 20. Primary blades 31, 32, 33 and secondary blades 34, 35, 36 extend generally radially along bit face 20 and then axially along a portion of the periphery of PDC bit 10. However, secondary blades 34, 35, 36 extend radially along bit face 20 from a position that is distal bit axis 11 toward the periphery of PDC bit 10. Thus, as used herein, "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting tip 44*a* furthest from blade tops 42, 52 to which cutting element 40 is mounted.

Referring now to FIG. 3, a profile of PDC bit 10 is shown as it would appear with each of the blades (e.g., primary blades 31, 32, 33 and secondary blades 34, 35, 36) and cutting faces 44 of each of the cutting elements 40 rotated into a single rotated profile. In rotated profile view, blade tops 42, 52 of each of blades 31-36 of PDC bit 10 form and define a combined or composite blade profile 39 that extends radially from bit axis 11 to outer radius 23 of PDC bit 10. Thus, as used herein, the phrase "composite blade profile" refers to the profile, extending from the bit axis to the outer radius of the bit, formed by the blade tops of each of the blades of a bit rotated into a single rotated profile (i.e., in rotated profile view).

Conventional composite blade profile 39 (most clearly shown in the right half of PDC bit 10 in FIG. 3) may generally be divided into three regions conventionally labeled cone region 24, shoulder region 25, and gage region 26. Cone region 24 comprises the radially innermost region of PDC bit 10 and composite blade profile 39 extending generally from bit axis 11 to shoulder region 25. As shown in FIG. 3, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 11 at the outer radial periphery of composite blade profile 39. Thus, composite blade profile 39 of conventional PDC bit 10 includes one concave region—cone region 24, and one convex region—shoulder region 25.

The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., PDC bit 10), the composite blade profile includes a single convex shoulder region (e.g., convex shoulder region 25), and a single blade profile nose (e.g., nose 27). As shown in FIGS. 1-3, cutting elements 40 are arranged in rows along blades 31-36 and are positioned along the bit face 20 in the regions previously described as cone region 24, shoulder region 25 and gage region 26 of composite blade profile 39. In particular, cutting elements 40 are mounted on blades 31-36 in predetermined radially-spaced positions relative to the central axis 11 of the PDC bit 10. Another way of expressing the blade profile may refer to the cone region 24 as being the inner radial portion defined by a straight line, the gage region 26 as the vertical portion. If a horizontal line is drawn at the outer radial end of the cone 24, then the region of the blade on the axial extreme of the blade (below the line as illustrated in FIG. 3) is the nose region 27, and the region on the side of the horizontal line towards the pin end of the bit (above the line as illustrated in FIG. 3) is the shoulder region 25.

For drilling harder formations, the mechanism for drilling changes from shearing to abrasion. For abrasive drilling, bits having fixed, abrasive elements are conventionally used. While PDC bits are known to be effective for drilling some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

Diamond impregnated drill bits are commonly used for boring holes in very hard or abrasive rock formations. The cutting face of such bits contains natural or synthetic diamonds distributed within a supporting material (e.g., metal-matrix composites) to form an abrasive layer. During operation of the drill bit, diamonds within the abrasive layer are gradually exposed as the supporting material is worn away. The continuous exposure of new diamonds by wear of the supporting material on the cutting face is the fundamental functional principle for impregnated drill bits.

An example of a prior art diamond impregnated drill bit is shown in FIG. 4. The impregnated bit 70 includes a bit body 72 and a plurality of ribs 74 that are formed in the bit body 72. Ribs 74 may extend from a center of the bit body radially outward to the outer diameter of the bit body 72, and then axially downward, to define the diameter (or gage) of the impregnated bit 70. The ribs 74 are separated by channels 76 that enable drilling fluid to flow between and both clean and cool the ribs 74. The ribs 74 are typically arranged in groups 79 where a gap 78 between groups 79 is typically formed by removing or omitting at least a portion of a rib 74. The gaps 78, which may be referred to as "fluid courses," are positioned to provide additional flow channels for drilling fluid and to provide a passage for formation cuttings to travel past the drill bit 70 toward the surface of a wellbore (not shown).

Referring now to FIG. 5, an example of a prior art impregnated bit 80 in accordance with U.S. Pat. No. 6,394,202, which is assigned to the assignee of the present invention and is hereby incorporated by reference, is shown. In FIG. 5, the impregnated bit 80 comprises a shank 82 and a crown 84. Shank 82 is typically formed of steel and includes a threaded pin 86 for attachment to a drill string. Crown 84 has a cutting face 88 and outer side surface 89. According to one or more embodiments, crown 84 is formed by infiltrating a mass of tungsten-carbide powder impregnated with synthetic or natural diamond.

Crown 84 may include various surface features, such as raised ribs 74. Formers may be included during the manufacturing process so that the infiltrated, diamond-impregnated crown includes a plurality of holes or sockets 85 that are sized and shaped to receive a corresponding plurality of diamond-impregnated inserts 83. Once crown 84 is formed, inserts 83 are mounted in the sockets 85 and affixed by any suitable method, such as brazing, adhesive, mechanical means such as interference fit, or the like. As shown in FIG. 5, the sockets 85 can be substantially perpendicular to the surface of the crown 84. As shown in FIG. 5, sockets 85 can each be substantially perpendicular to the surface of the crown 84. In this embodiment, the sockets 85 are inclined such that inserts 83 are oriented substantially in the direction of rotation of the bit, so as to enhance cutting.

Referring now to FIG. 6, an example of a cross-sectional view of a rib of a prior art impregnated drill bit is shown. The rib 74 has a profile 90 defining its general shape/geometry that may be divided into various segments: a cone region 92 (recessed central area), a nose region 94 (leading cutting edge of profile), a shoulder region 96 (beginning of outside diameter of bit), transition region 98 (transition between shoulder and vertical gage), and a gage region 99 (vertical region defining outer diameter of bit). The primary cutting portion of the rib 74 includes cone region 92, nose region 94, and shoulder region 96, whereas gage region 99 is primarily responsible for maintaining the hole size.

Without regard to the type of bit, the cost of drilling a borehole is proportional to the length of time it takes to drill the borehole to the desired depth and location. The drilling time, in turn, is greatly affected by the number of times the drill bit is changed in order to reach the targeted formation. This is the case because each time the bit is changed, the entire drill string, which may be miles long, is retrieved from the borehole section by section. Once the drill string has been retrieved and the new bit installed, the bit is lowered to the bottom of the borehole on the drill string, which again is constructed section by section. This process, known as a "trip" of the drill string, involves considerable time, effort, and expense. Accordingly, it is desirable to employ drill bits that will drill faster and longer and that are usable over a wider range of differing formation hardnesses and applications.

The length of time that a drill bit may be employed before it is changed depends upon its rate of penetration ("ROP"), as well as its durability or ability to maintain a high or acceptable ROP. Specifically, ROP is the rate that a drill bit penetrates a given subterranean formation. ROP is typically measured in feet per hour. There is an ongoing effort to optimize the design of drill bits to more rapidly drill specific formations so as to reduce drilling costs, which are affected by ROP.

Once a desired formation is reached in the borehole, a core sample of the formation may be extracted for analysis. Conventionally, a hollow coring bit is employed to extract a core sample from the formation. Once the core sample has been transported from the borehole to the surface, the sample may be used to analyze and test, for example, permeability, porosity, composition, or other geological properties of the formation.

Regardless of the type of drill bit employed to drill the formation, conventional coring methods involve retrieval of the drill string from the borehole, replacement of the drill bit with a coring bit, and lowering of the coring bit into the borehole on the drill string in order to retrieve a core sample, which is then taken along the path of the borehole to reach the surface for analysis. That is, conventional coring methods involve tripping the drill string, and thus considerable time, effort, and expense.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a fixed cutter drill bit that includes a bit body having a bit centerline; a plurality of blades extending radially from the bit body and separated by a plurality of flow courses therebetween, each of the plurality of blades being spaced a radial distance from the bit centerline to define a core-forming region; a plurality of cutting elements disposed on the plurality of blades, the plurality of cutting elements comprising at least one coring cutting elements disposed on at least one of the plurality of blades, the at least one coring cutting elements being the radially innermost cutting element on the plurality of blades, wherein an inner cone angle of the at least one coring cutting element is defined as an angle between the bit centerline and a tangential line extending between the at least one coring cutting element and a radially adjacent cutting element that cuts the bottom hole, wherein a coring angle of the at least one coring cutting element is defined as an angle between a line perpendicular to the bit centerline and an axis of the at least one coring cutting element projected onto the line perpendicular to the bit centerline, when the at least one coring cutting element is rotated about the bit centerline until a tip of the at least one coring cutting element touches the tangential line, and wherein the coring angle is less than the inner cone angle.

Other aspects and advantages of the claimed subject matter will be apparent from the following description and the appended claims.

DETAILED DESCRIPTION

Embodiments of the present disclosure will be described below with reference to the figures. In one aspect, embodiments disclosed herein relate to fixed cutter drill bits for obtaining core sample fragments from a subterranean formation. In particular, embodiments disclosed herein relate to the orientation of a cutting element on a fixed cutter drill bit that cut and form the core sample fragments, and specifically, the orientation of the cutting element at the first radial position on the fixed cutter drill bit.

Figure 7:
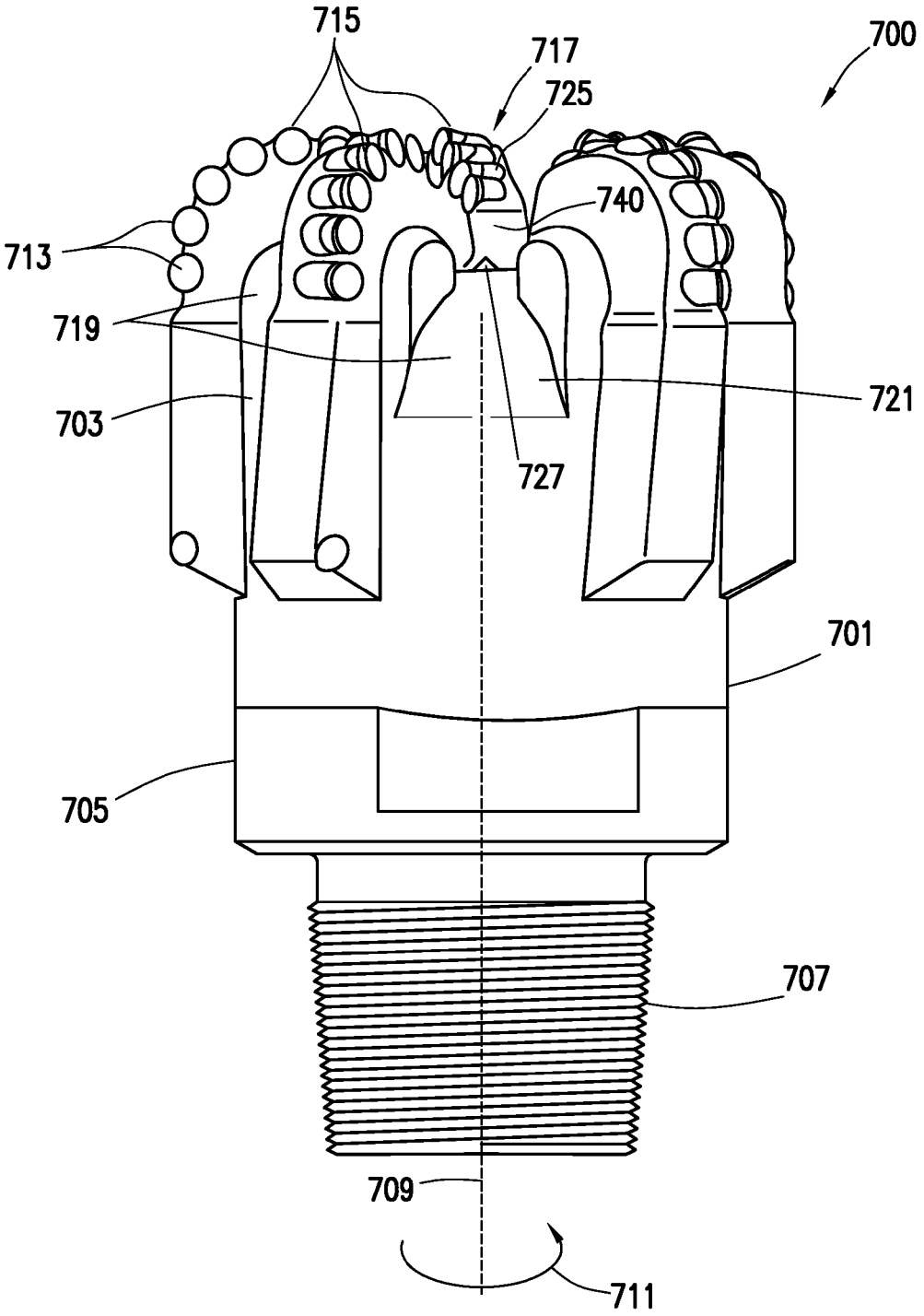
FIGS. 7-8 shows an embodiment of a fixed cutter drill bit.

Referring now to FIG. 7, a perspective view of a drill bit is shown. As shown, the drill bit is a PDC bit 700 that includes a bit body 701, a shank 705, and a pin 707. Pin 707 is used to secure PDC bit 700 to the lower end of a drill string (not shown). PDC bit 700 further includes a bit centerline 709 about which PDC bit 700 rotates in the cutting direction represented by arrow 711. According to one or more embodiments of the present disclosure, bit body 701 extends through bit centerline 709 and smoothly transitions into and between flow courses 719, which are described in further detail below.

When PDC bit 700 is secured to the drill string, rotating the drill string causes PDC bit 700 to rotate and penetrate and cut through a subterranean formation using a plurality of cutting elements 713, which are described in further detail below. As PDC bit 700 penetrates and cuts through the subterranean formation, a wellbore is formed.

As shown in FIG. 7, bit body 701 of PDC bit 700 supports a plurality of blades 715. Plurality of blades 715 are formed on an end of PDC bit 700 that is opposite pin 707. As shown, plurality of blades 715 extend radially along bit body 701 and then axially along a portion of the periphery of PDC bit 700. According to one or more embodiments of the present disclosure, one of the plurality of blades is a coring blade 717, which is described in further detail below. Plurality of blades 715 are separated by a plurality of flow courses 719, which enable drilling fluid to flow between and both clean and cool plurality of blades 715 during drilling. In one or more embodiments of the present disclosure, one of the plurality of flow courses 719 may optionally be an evacuation slot 721, which is described in further detail below.

As further shown in FIG. 7, each of the plurality of blades 715 includes plurality of cutting elements 713 disposed thereon. As shown, plurality of cutting elements 713 are arranged adjacent one another in a radially extending row proximal the leading edge of each of the plurality of blades 715. Plurality of cutting elements 713 may have a substantially planar cutting face in order to achieve a shearing cutting action while drilling a formation. In other embodiments, any one of the plurality of cutting elements 713 may be rotatable cutting elements, such as those disclosed in U.S. Pat. No. 7,703,559, U.S. Patent Publication No. 2010/0219001, 2011/0297454, 2012/0273281, 2012/0273280, and 2014/0054094, all of which are assigned to the present assignee and herein incorporated by reference in their entirety. In other embodiments, any one of the plurality of cutting elements 713 may be "non-planar cutting elements," such as those described in U.S. Patent Publication Nos. 2013/0277120, 2012/0205163, 2012/0234610, and 2013/0020134, all of which are assigned to the present assignee and herein incorporated by reference in their entirety.

Figure 8:
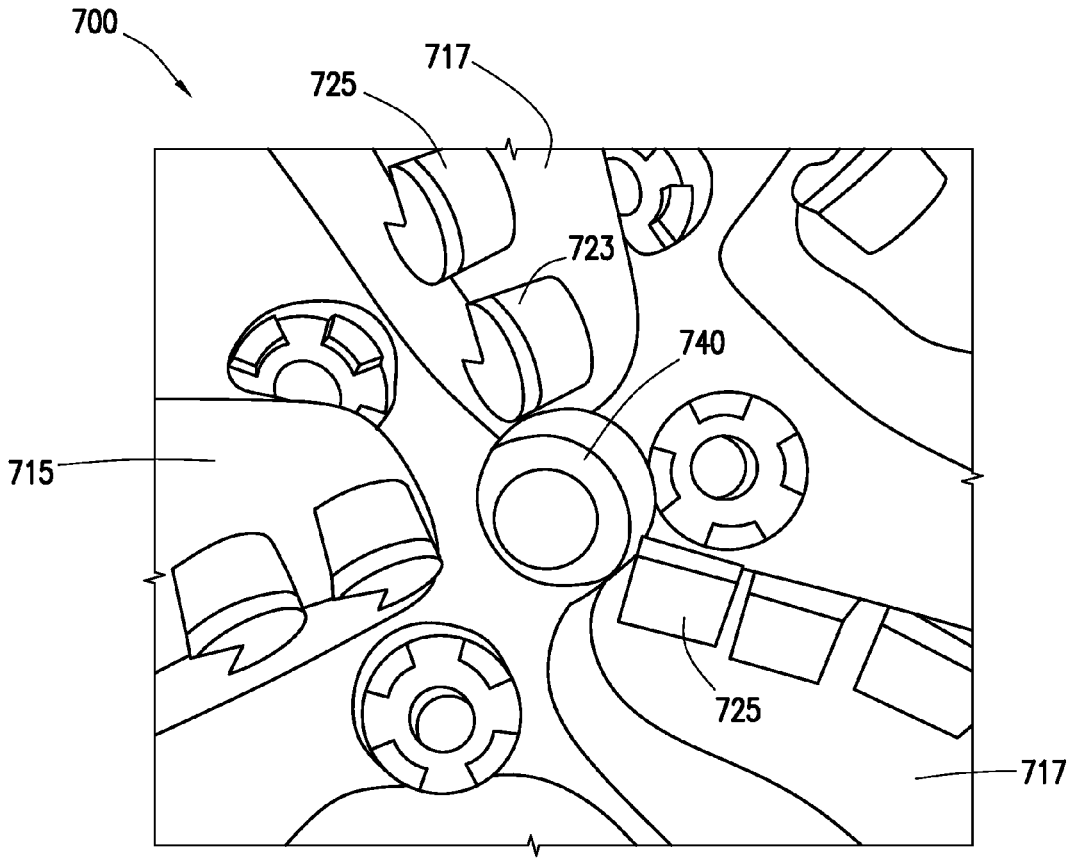

According to one or more embodiments of the present disclosure, at least one of the radially most interior cutting elements 713 is a coring cutting element 725 disposed on coring blade 717. As used herein, the terms "coring cutting element" and "coring blade" refer to a particular cutting element and blade that cuts the formation in such a manner that a core sample fragment is formed. In one or more embodiments, other optional features may be included to help break the core for evacuation through the annulus. Further, as mentioned, bits of the present disclosure may include at least one coring cutting element, and in particular embodiments, may include at least two coring cutting elements, as discussed in U.S. Patent Application No. 61/876,630 entitled "Fixed Cutter Drill Bit with Multiple Cutting Elements at First Radial Position to Cut Core", which is incorporated by reference in its entirety. For example, referring now to FIG. 8, a partial view of a fixed cutter bit having two coring cutting elements is shown. The bit 700 includes a plurality of blades 715, two of which are coring blades 717. On coring blades 717, coring cutting elements 725 are included. As illustrated, coring cutting elements 725 cut a cylindrical core 740. Further, according to embodiments of the present disclosure, such core 740 is cut using at least one coring cutting element 725 that also cuts the bottom hole (advancing the formation of the wellbore). In some embodiments, the back-up coring cutting element 725 does not necessarily cut both the core and bottom hole, but can cut the core sidewall (but not the bottom hole), in one or more embodiments.

Figure 9:
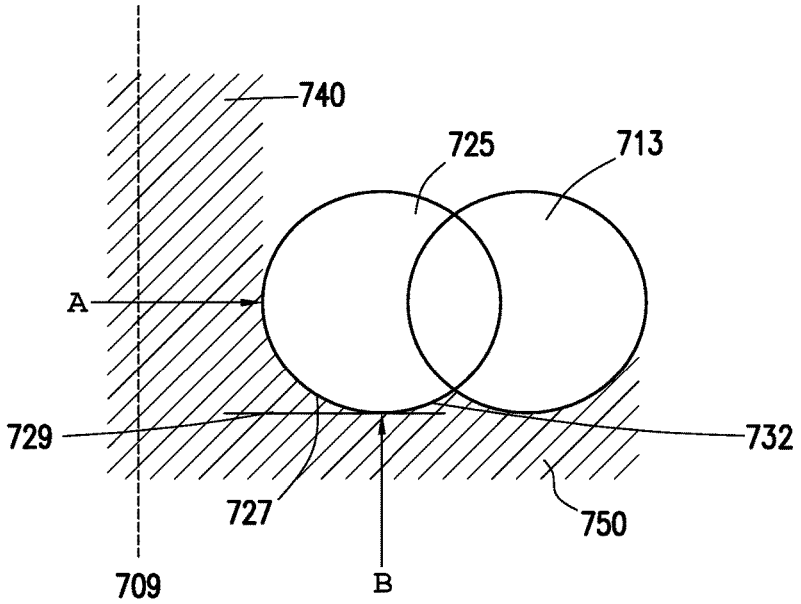
FIG. 9 shows an embodiment of a coring cutting element of the present disclosure.

As used herein, the "core" is a substantially cylindrical portion of the formation that is allowed to remain uncut axially above the cutting profile of cutting elements and adjacent the bit center. As illustrated in FIG. 9, the shape of core 740 is defined by a portion of cutting edge 727 of coring cutting element 725. The cutting edge may generally be described as the active cutting zone of the coring cutting element. That is, it is the portion of the cutting element that cuts the formation when the bit engages with the formation. Cutting edge may refer to an edge formed between two intersecting surfaces, whereas a cutting zone may more generally describe the region (and is not limited by two intersecting surfaces) in cases where cutting elements of other shapes may be used. As mentioned above, coring cutting elements 725 are the radially most interior cutting elements 713 on blades (not shown). The portion of cutting edge 727 that forms the core extends an arc length (indicated by arrows A and B) of approximately 90 degrees from the radially innermost extent (at arrow A) of coring cutting element to the point (at arrow B) where the tangent 729 to the cutting edge 727 is substantially perpendicular with the bit centerline 709. The core diameter is dependent on the radial distance from bit centerline 709 to the radially innermost extent of coring cutting element 725. The point at arrow B where the tangent 729 to the cutting edge 727 is perpendicular to the bit centerline 709 is also the point at which the coring cutting element 725 also cuts the bottom hole 750. Thus, as defined herein, a coring cutting element 725 cuts both the core 740 and bottom hole 750.

As mentioned above, bits formed in accordance with the present disclosure may include a single coring cutting element, or may be formed with two or more coring cutting elements. When multiple coring cutting elements are present, such coring cutting elements may be located on the same or differing blades. In one or more embodiments, at least one coring cutting element 725 is oriented and disposed on a blade so as to be able cut a portion of the bottom hole 750. Referring to FIG. 9, for ease of explanation, the bottom hole 750 is defined as being radially outside the point (indicated by the arrow B) on the cutting edge 727 where the tangent 729 to the cutting edge 727 is perpendicular to the bit centerline 709. Thus, coring cutting element 725 cuts a core 740 by the portion of the cutting edge 727 that is radially inside of the relevant tangent point at arrow B, whereas a bottom-hole cutting portion 732 is the cutting edge 727 arc that is radially outside of the relevant tangent point at arrow B.

Figure 1:
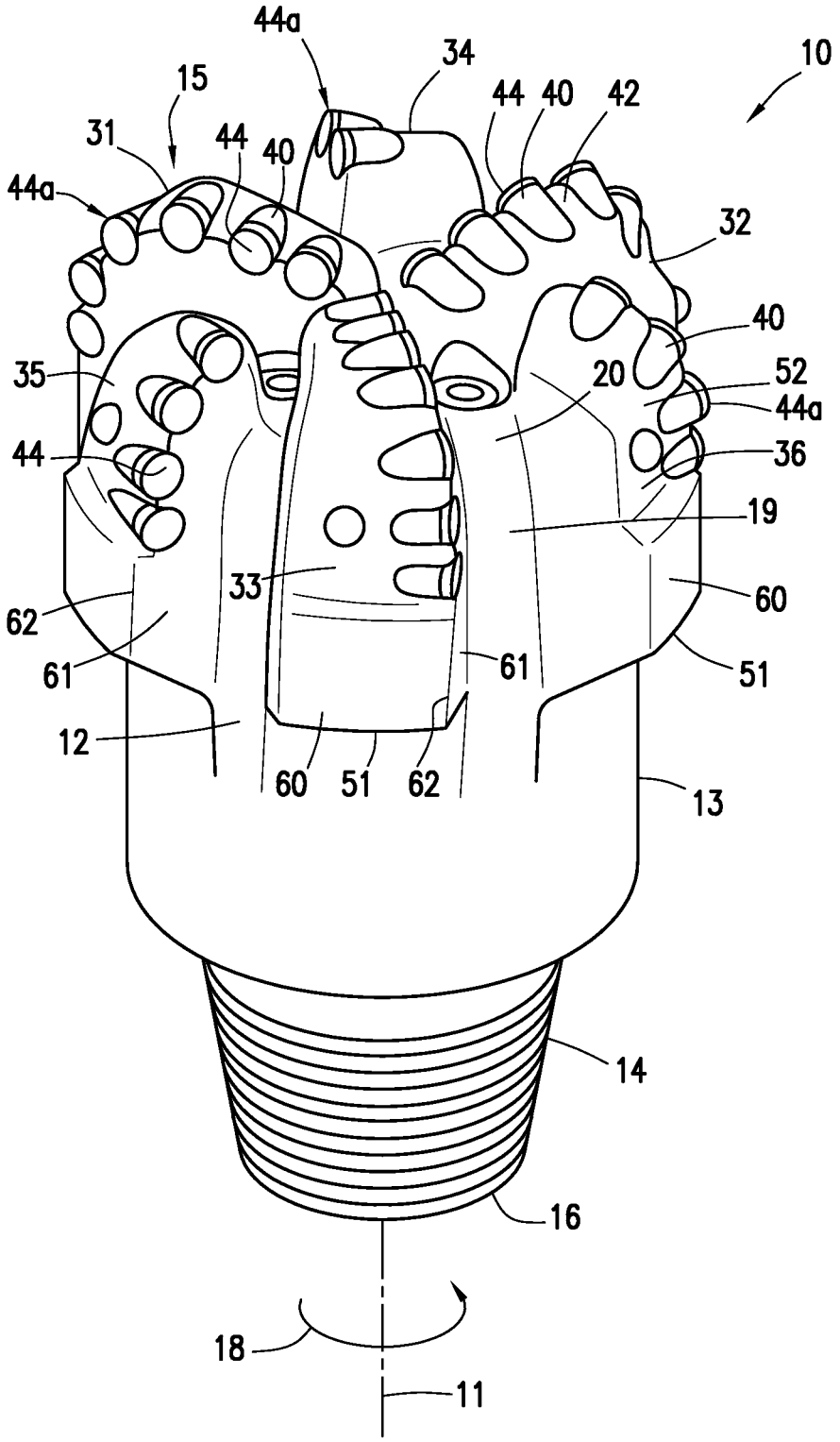
FIG. 1 (PRIOR ART)
FIG. 1 shows a perspective view of a conventional PDC drill bit.
Figure 2:
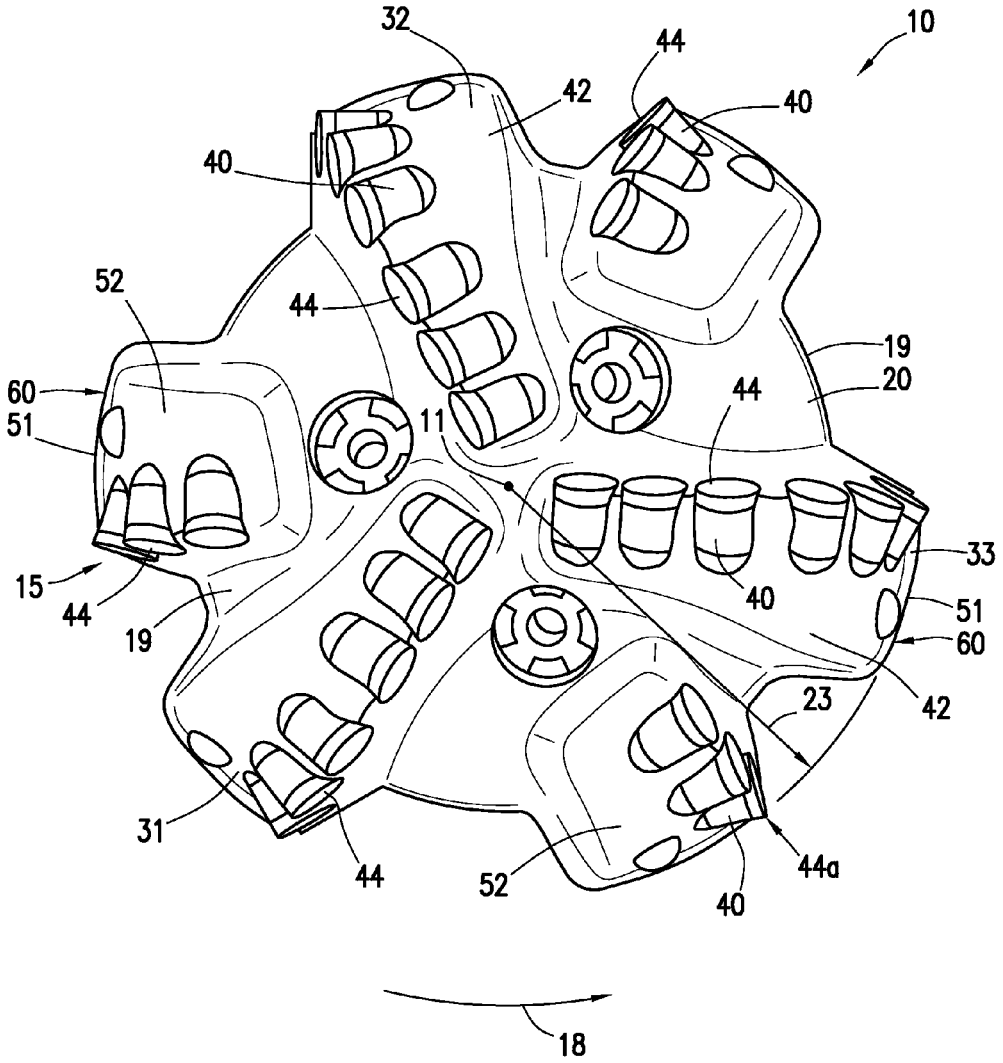
FIG. 2 (PRIOR ART)
FIG. 2 shows a top view of a conventional PDC drill bit.
Figure 3:
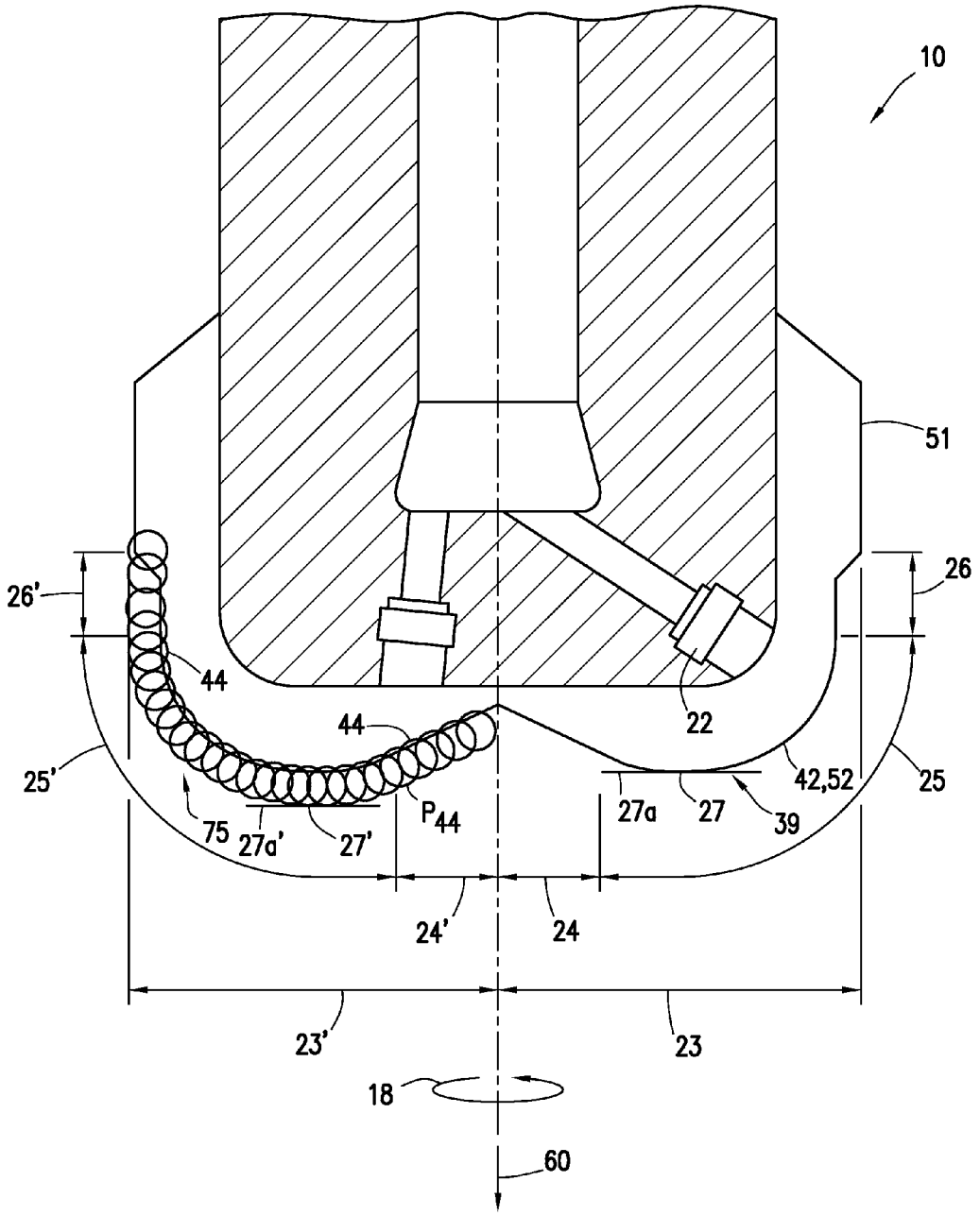
FIG. 3 (PRIOR ART)
FIG. 3 shows a cross-sectional view of a conventional PDC drill bit.
Figure 4:
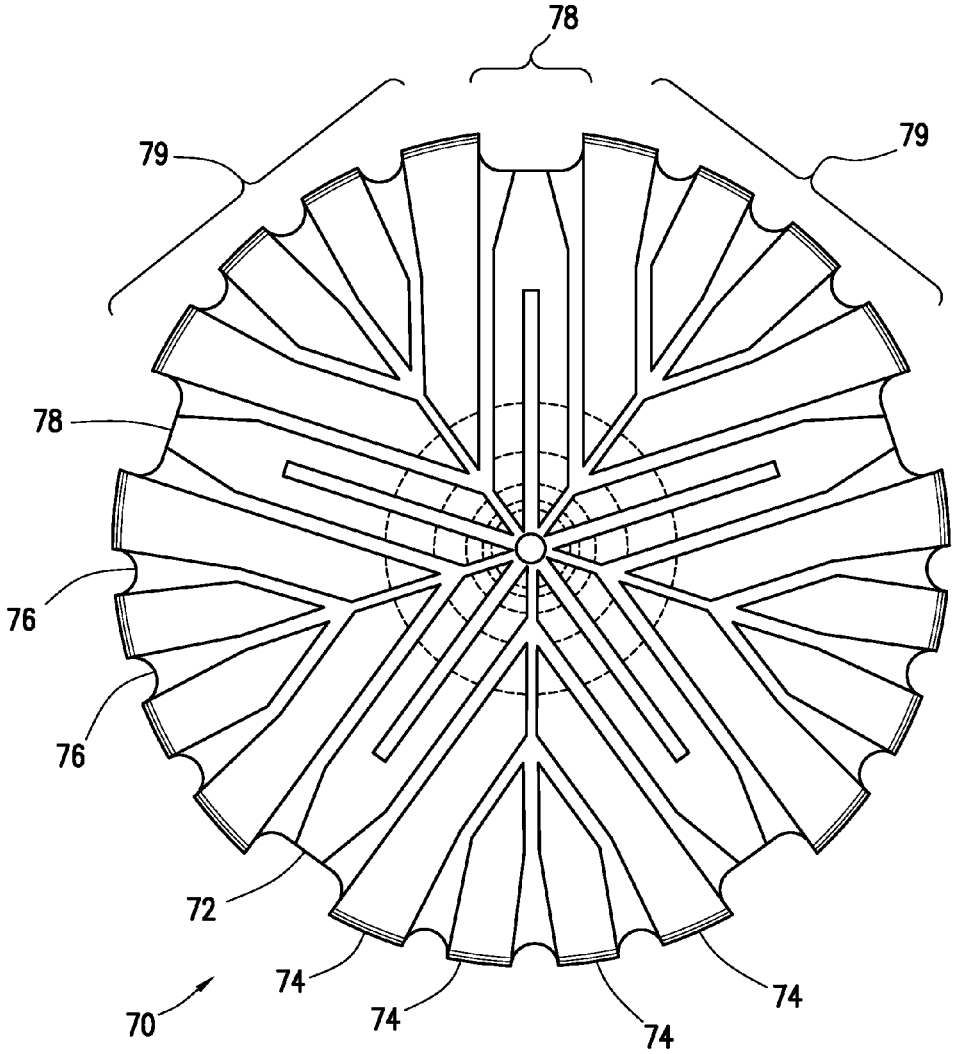
FIG. 4 (PRIOR ART)
FIG. 4 shows a top view of a conventional impregnated drill bit.
Figure 5:
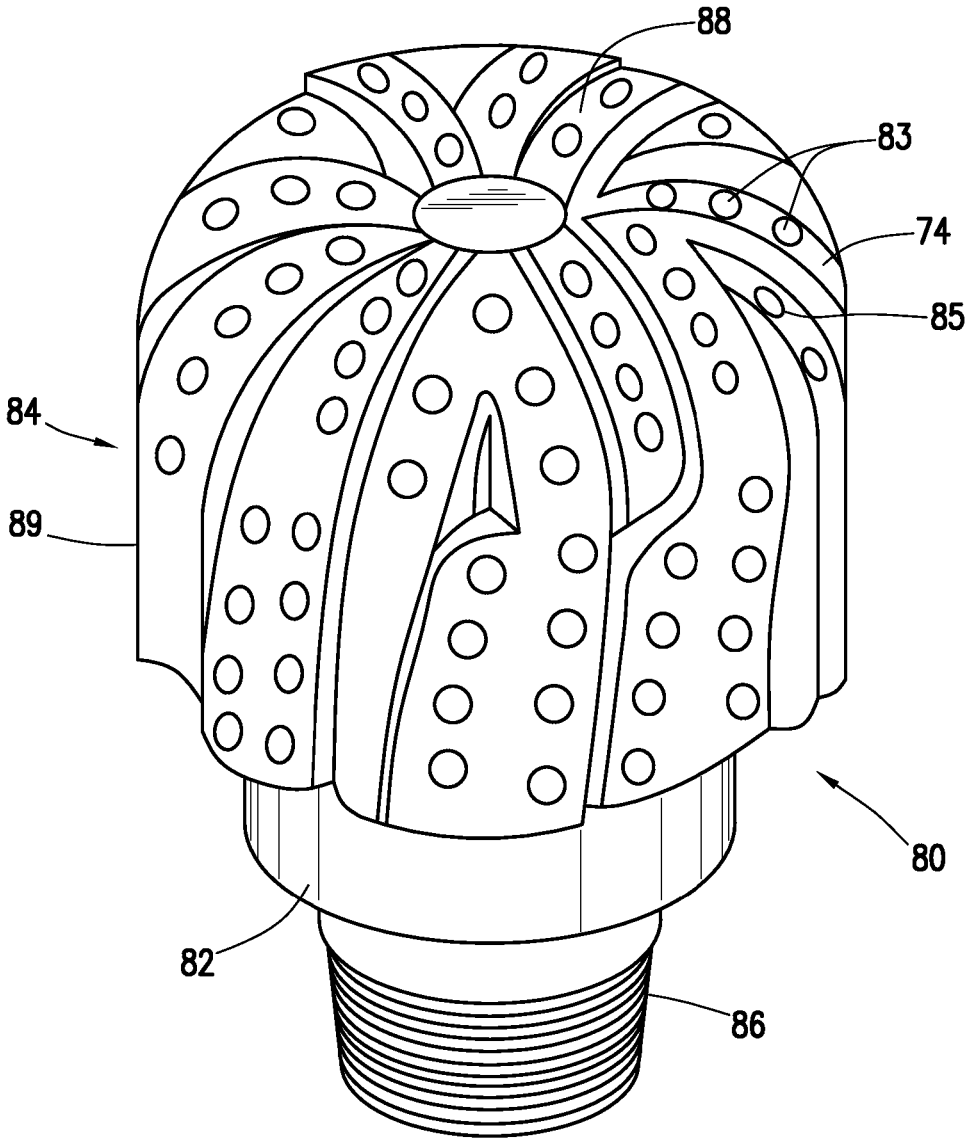
FIG. 5 (PRIOR ART)
FIG. 5 shows a perspective view of a conventional impregnated drill bit.
Figure 6:
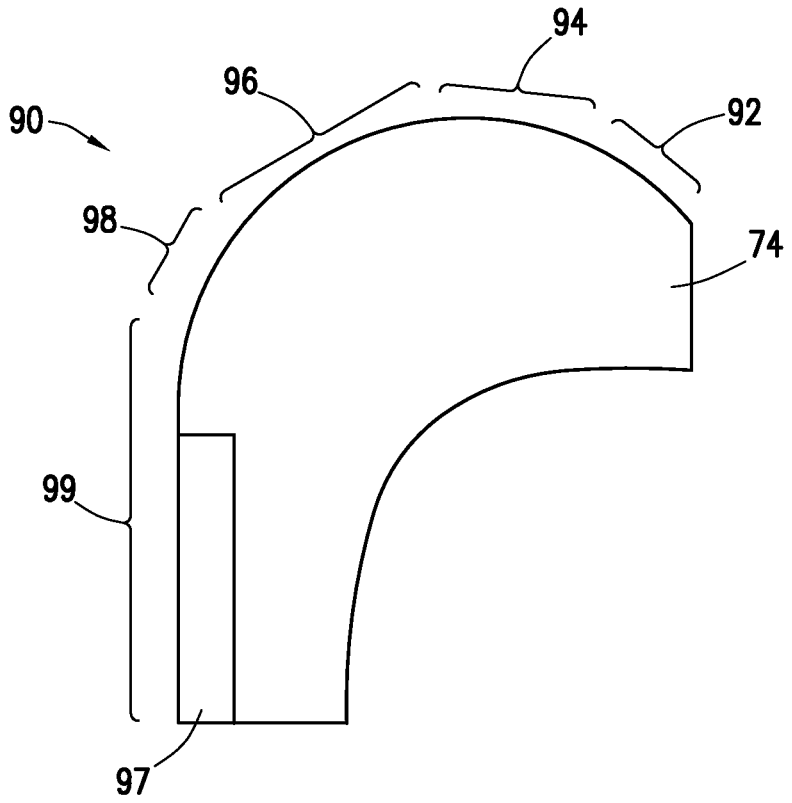
FIG. 6 (PRIOR ART)
FIG. 6 shows a cross-sectional view of a rib of a conventional impregnated drill bit.
Figure 10:
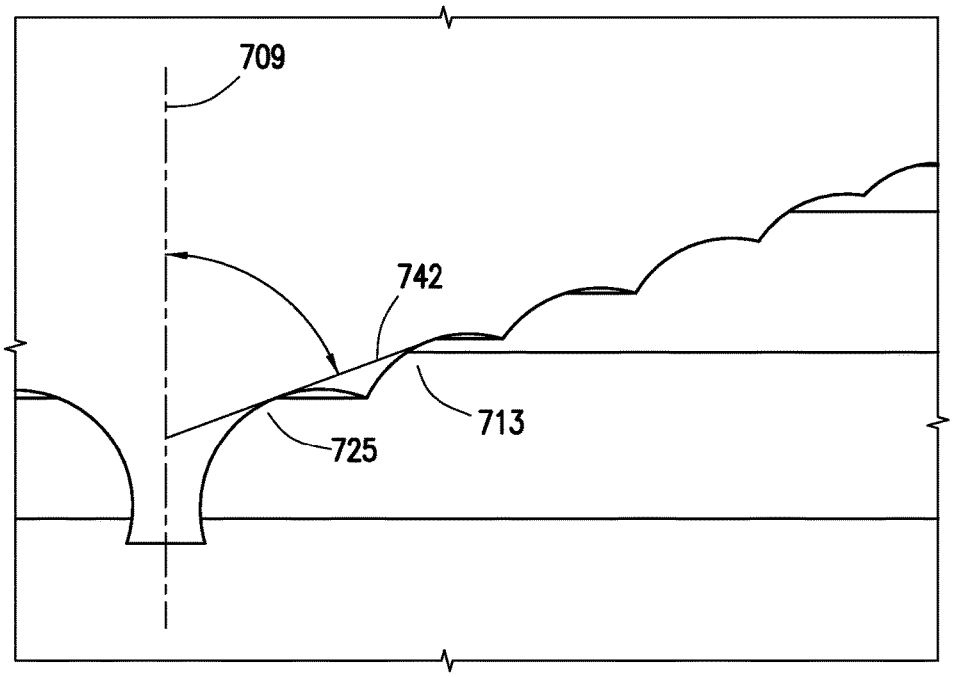
FIGS. 10-12 show embodiments of orientation of a coring cutting element of the present disclosure.
Figure 15:
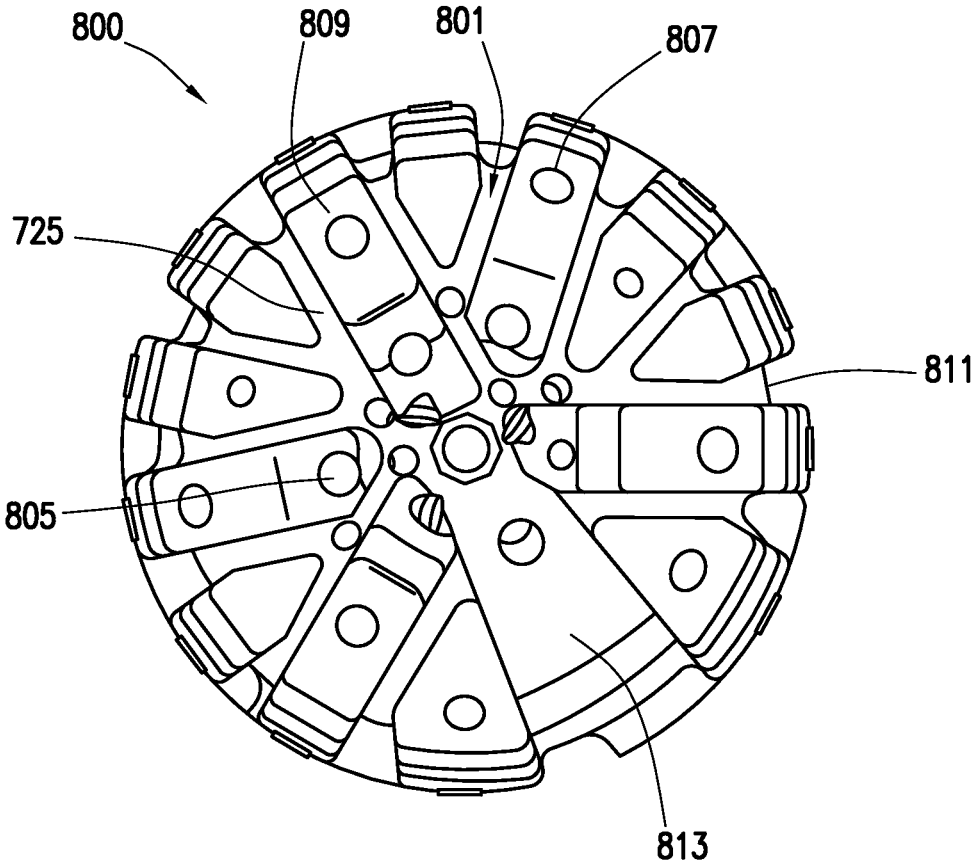
FIGS. 15-17 show embodiments of a fixed cutter drill bit.

Referring now to FIG. 10, one view of an orientation of a coring cutting element is shown. As shown in FIG. 10, an inner cone angle may be defined as the angle between the bit axis 709 and a tangential line 742 extending between both the first radial cutting 725 and a radially adjacent cutter 713 that does not cut the core. As defined herein, the radially adjacent cutter refers to the cutting element 713 adjacent to the first radial cutting element or coring cutting element 725 (as defined above), when each of the cutting elements are rotated onto a single plane (referenced as a rotatable profile view such as illustrated in FIG. 3), that engages with the bottom hole, but not the core. Thus, the radially adjacent cutting element 713 can, but need not be, on the same blade as the coring cutting element 725, and in one or more embodiments, is on a different blade. Another way of expressing such a radially adjacent cutting element may be with respect to the grooves formed in the bottom hole, upon engagement of the cutting elements with the formation. The line 742 tangent to both the coring cutting element 725 and the radially adjacent cutting element 713 is extended to intersect with the bit centerline 709, and the inner cone angle is defined as the angle between the bit centerline 709 and the line 742 tangent to both the coring cutting element 725 and the radially adjacent cutting element 713. As mentioned, the inner cone angle is defined based on a line that is tangential to both the coring cutting element 725 and the radially adjacent cutter 713. The radially adjacent cutting element 713, referring back to FIG. 9, is defined herein as having a cutting edge that engages the formation radially outside the point (indicated by the arrow B) on the cutting edge 727 of coring cutting element 725 where the tangent 729 to the cutting edge 727 is perpendicular to the bit centerline 709. If a bit has multiple cutting elements at the first radial position (as defined in U.S. Patent Application No. 61/876,630 entitled "Fixed Cutter Drill Bit with Multiple Cutting Elements at First Radial Position to Cut Core"), such cutting elements are defined as having an active or engaged cutting edge that falls radially inside the point where tangent 729 is perpendicular to bit centerline 709. Thus, such cutting elements would not be used to define the inner cone angle. It is also within the scope of the present disclosure that the coring cutting elements 725 may be used on diamond impregnated bits (as illustrated in FIG. 15 below) that do not contain other shearing cutting elements. On such bits, the inner cone angle may be defined based on a line tangent to both the coring cutting element and a radially adjacent diamond impregnated insert (instead of a shearing cutter). In one or more embodiments, the inner cone angle may range from 55 degrees to 90 degrees, or at least 57.5, 60, or 70 degrees and/or up to 75, 80, 85, or 88 degrees in one more or more other embodiments, where any lower limit can be used in combination with any upper limit.

Figure 11:
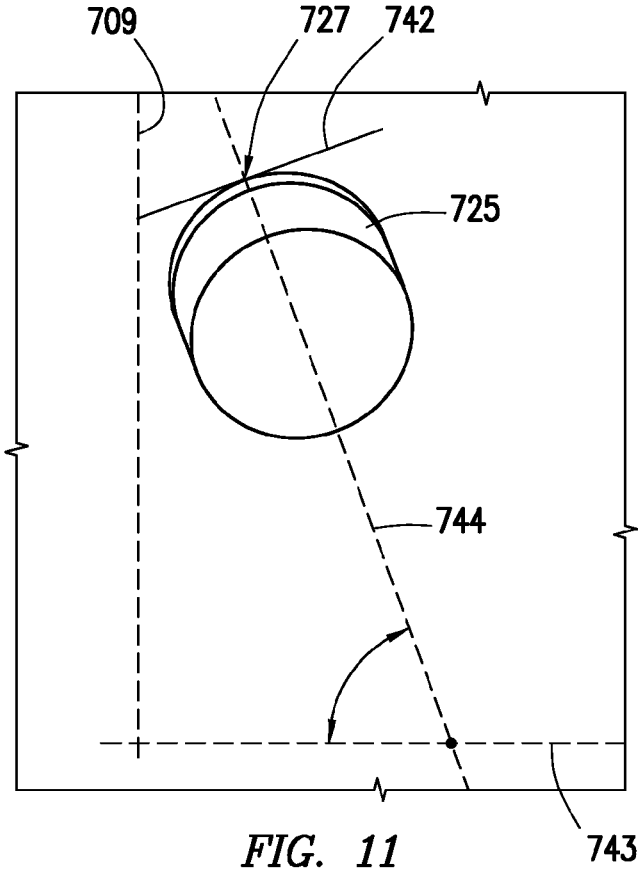

Referring now to FIG. 11, a view of an orientation of a coring cutting element is shown. As shown in FIG. 11, a coring angle may be defined to indicate an orientation of the coring cutting element to cut both a core and the bottom hole. Specifically, the inventor of the present disclosure has determined that possess adequate exposure of a cutting edge 727 of the coring cutting element to cut both a core sidewall and bottom hole in a manner that will fail the rock, the coring cutting element may be orientated at a particular coring angle. The coring angle may be defined as the angle between a line 743 perpendicular to the bit axis 709 and the axis 744 of the coring cutting element 725 (when the coring cutting element 725 is rotated about the bit axis until the tip of the coring cutting element touches the above tangential line described in FIG. 10). In one or more embodiments, a desirable coring angle (to affect the desired core sidewall and bottomhole cutting action) may be less than the inner cone angle. One or more embodiments may possess a coring angle that is at least 50 percent, at least 60 percent, at least 65 percent, 70 percent, 75 percent, or 80 percent of the inner cone angle. Further, any of such lower limits may be used in combination with one or more upper limits of less than 100 percent, no more than 95 percent, no more than 90 percent, no more than 85 percent, no more than 80 percent, or no more than 75 percent. The selection of the range may be based, for example, on the size of the core (core diameter). As the core diameter (and thus core strength) is increased, the selected range may vary, as the amount of bias of the coring cutting element towards the core may be to increased to cut the rock core. Specifically, use of a coring angle that is less than the cone angle may ensure that the core is cut by cutting edge of the coring cutting element, and not by a side surface of the diamond table and/or side of the substrate. Orienting the coring cutting element by the coring angle may allow for the coring cutting element to have the desired rake angle with respect to both the bottom hole and core sidewall so that shearing of both formation regions can occur.

Figure 12:
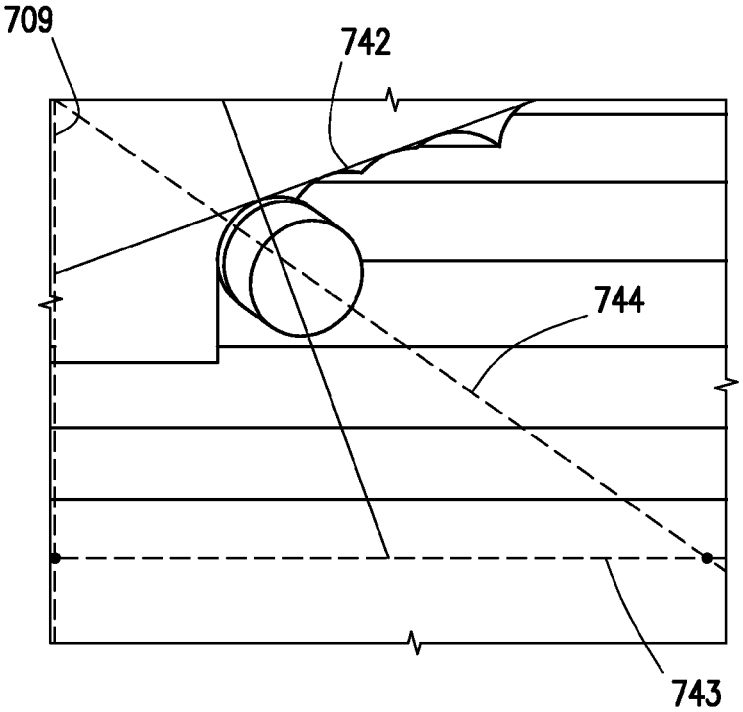

As illustrated in FIGS. 10 and 11, the inner cone angle and coring angle are equal, however, FIG. 12 illustrates an orientation of the coring cutting element such that the coring angle is less than the inner cone angle. Specifically, by changing the orientation of the coring cutting element, the projected coring cutting element axis 744 (when the coring cutting element is rotated so that its tip lies on the tangential line defining the inner cone angle) with respect to the bit centerline 709 (or line 743 perpendicular to the bit centerline) likewise changes. Such changes in the coring cutting element (and thus coring angle) may be achieved by changing the back rake and/or side rake of the coring cutting element. As mentioned above, in one or more embodiments, the coring angle of the coring cutting element may be at least 50% and less than 100% of the inner cone angle, so that the coring cutting element may oriented in a manner that allows for shearing of both the core sidewall and the bottom hole.

Figure 13:
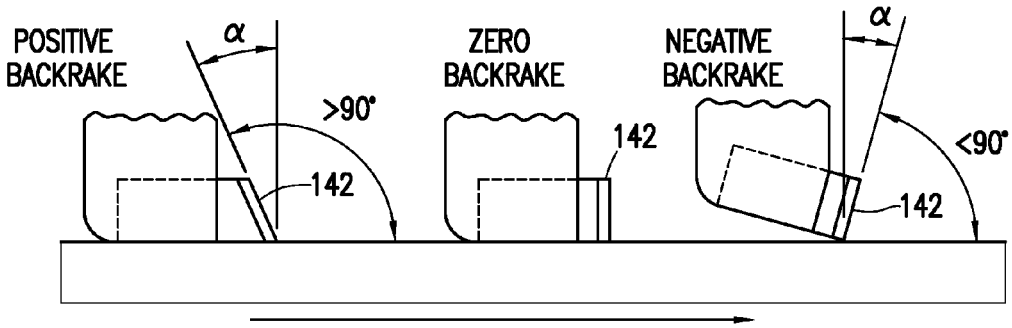
FIGS. 13-14 show rake angles of a cutting element of the present disclosure.

Change in the coring angle may result from a change in the back rake (i.e., a vertical orientation) and/or the side rake (i.e., a lateral orientation) of a coring cutting element. Referring to FIG. 13, back rake is defined as the angle $\alpha$ formed between the cutting face of the cutter 142 and a line that is normal to the formation material being cut. As shown in FIG. 13, with a conventional shear cutter 142 having zero back rake, the cutting face 44 is substantially perpendicular or normal to the formation material. Because the coring cutting element cuts formation material at both the bottom hole and the core sidewall, the back rake angle may be measured with respect to a line parallel with the bit centerline or longitudinal axis of the bit and is the angle between the cutting face and line parallel to the bit centerline. A cutter 142 having negative back rake angle $\alpha$ has a cutting face 44 that engages the bottom hole at an angle that is less than 90° as measured from the bottom hole formation material. Similarly, a cutter 142 having a positive back rake angle $\alpha$ has a cutting face 44 that engages the bottom hole at an angle that is greater than 90° when measured from the bottom hole. According to various embodiments of the present disclosure, the back rake of the coring cutting elements may be any of a lower limit of at least −5, −8, −10, or −12 degrees, and an upper limit of any of up to −15, −18, −20, −25, or −30 degrees, where any lower limit can be used in combination with any upper limit.

Figure 14:
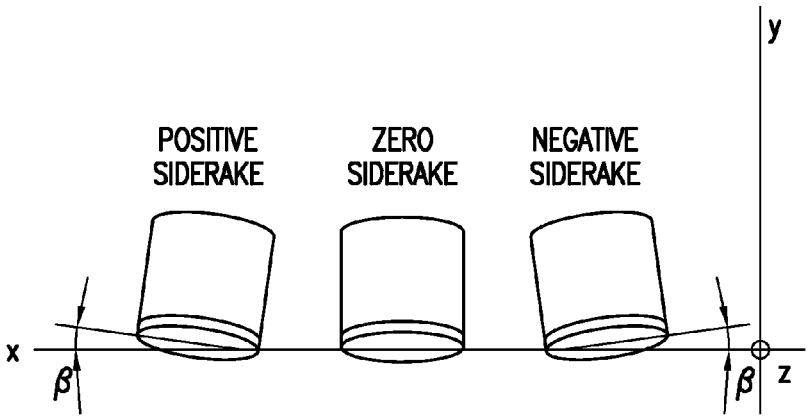

For shear cutters, side rake is defined as the angle between the cutting face and the radial plane of the bit (x-z plane), as illustrated in FIG. 14. When viewed along the z-axis, a negative side rake angle $\beta$ results from counterclockwise rotation of the cutter, and a positive side rake angle $\beta$, from clockwise rotation. In a particular embodiment, the side rake of cutters may range from −30 to 0 degrees, and greater than −2, −5, or −7 degrees in one or more particular embodiments. Further, the negative side rake values on the first radial cutting element (the coring cutting element) are compared to the side rake values on the radially outer cutting elements, which may have positive side rake angles, ranging, for example, from 0 to 5 degrees.

Referring now to FIG. 15, an embodiment of a fixed cutter drill bit is shown. As shown in FIG. 15, the fixed cutter drill bit 800 is a diamond impregnated bit. As shown in FIG. 15, bit body 801 supports a plurality of raised ribs 807. Similar to plurality of blades 715 of PDC bit 700 (illustrated in FIG. 7), according to one or more embodiments of the present disclosure, plurality of raised ribs 807 include a raised volume of material that extends at a height from a face of bit body 801. However, as appreciated by one of ordinary skill in the art, such "blades" on an impregnated drill bit are generally referred to in the art as "ribs." Thus, any referenced to a fixed cutter bit and/or blades may be to either a PDC bit or a diamond impregnated bit. Plurality of raised ribs 807 are formed on an end of impregnated bit 800 that is opposite pin (not shown). As shown, plurality of raised ribs 807 extend radially outward from bit centerline (not shown), and then axially downward to define a diameter of impregnated bit 800.

According to one or more embodiments of the present disclosure, one of the plurality of raised ribs 807 is a coring rib 809, having a coring cutting element thereon, similar to the embodiments described above. In such an instance, one of ordinary skill in the art would appreciate that the coring cutting elements 725 may be the sole "cutters" as that term is generally understood in the art of PDC bits. Other "cutting structures" may include diamond impregnated inserts or diamond impregnated ribs, discussed below.

Plurality of raised ribs 807 are separated by a plurality of channels 811, which enable drilling fluid to flow between and both clean and cool plurality of raised ribs 807 during drilling. Optionally, one of the plurality of channels 811 is an evacuation slot 813, which is described in further detail below. As further shown in FIG. 15, each of plurality of raised ribs 807 includes an impregnated cutting structure, through either diamond (or other superabrasive) particles impregnated in the ribs 807 or a plurality of holes into which plurality of impregnated inserts 805 are disposed. It is also within the scope of the present disclosure that plurality of raised ribs 807 may include both diamond impregnation in the rib 807 itself as well as impregnation in inserts 805 fitted into holes formed in the raised ribs 807. According to one or more embodiments of the present disclosure, plurality of holes are sized and shaped to receive corresponding plurality of impregnated inserts 805. As shown, plurality of impregnated inserts 805 may be arranged adjacent one another and/or spaced along plurality of raised ribs 807. According to one or more embodiments of the present disclosure, plurality of impregnated inserts 805 may be oriented to be substantially parallel to bit centerline (not shown), or may be oriented to be substantially perpendicular to bit centerline (not shown), depending on the position of plurality of impregnated inserts 805 along plurality of raised ribs 807, or may be oriented in the same axial direction or plane as the rib 807. Plurality of impregnated inserts 805 and/or ribs 807 may be formed of natural or synthetic diamonds, as well as other non-superabrasive materials in order to achieve an abrasive cutting action while drilling a formation.

In various embodiments, cutting elements have been described as having "substantially the same" distance from a bit centerline or axial height. In each of those embodiments, such variation may be within 0.100 inches. It is also noted that in each of such embodiments, it is also within the scope of the present disclosure that each of distances or heights may also be the same (within manufacturing tolerances).

Referring back to FIG. 7, in accordance with one or more embodiments of the present disclosure, the first coring cutting element is located at some distance away from bit centerline 709 to allow for the formation of core sample fragment 740. As a non-limiting example, according to one or more embodiments of the present disclosure, the radially most interior portion of the cutting edge of coring cutting element 725 is distanced from bit centerline 709 at a distance that measures 0.25 times the diameter of PDC bit 700. According to one or more embodiments of the present disclosure, the radially most interior portion of the cutting edge of coring cutting element 725 may be distanced from bit centerline 709 at a distance measuring in a range of 0.05 times the diameter of PDC bit 700 to 0.25 times the diameter of PDC bit 700. According to other embodiments of the present disclosure, the radially most interior portion of the cutting edge of coring cutting element 725 may be distanced from bit centerline 709 at a distance measuring in a range having a lower limit of any of 0.05, 0.075, 0.1, 0.125, or 0.15 times the diameter of PDC bit 700 to an upper limit of any of 0.075, 0.1, 0.125, 0.15, 0.175, 0.2, 0.225, or 0.25 times the diameter of PDC bit 700, where any lower limit may be used in combination with any upper limit. As understood by one of ordinary skill in the art, the radially most interior portion of the cutting edge of coring cutting element 725 may be located at other distances away from bit centerline 709, depending on the desired size of the core sample fragment 740, without departing from the scope of the present disclosure. Further, such distances (defining the core radius) may also be expressed in numerical values, not as a value relative to the bit size. In one or more embodiments, the core diameter may range from 0.8 to 1.2 inches (2.03 to 3.05 cm), may range from 1.2 to 1.8 inches (3.05 to 4.57 cm) in one or more other embodiments, or be greater than 1.8 inches (4.57 cm) in yet other embodiments. In an embodiment having a core diameter of 0.8 to 1.2 inches (2.03 to 3.05 cm), the coring angle may range from 65 to 85 percent of the inner cone angle. In an embodiment having a core diameter of 1.2 to 1.8 inches (3.05 to 4.57 cm), the coring angle may range from 50 to 75 percent of the inner cone angle. Further, for even larger core diameters, the coring angle could even be less than 50% of the inner cone angle.

Further, it is also within the scope of the present disclosure that other features may be included on the fixed cutter drill bits of the present disclosure, including such features as discussed in U.S. Patent Publication No. 2013/0020134, which is assigned to the present assignee and herein incorporated by reference in its entirety, which may aid in the formation and/or evacuation of a core segment. Such features may include an evacuation channel, a center insert disposed proximate the bit centerline, and/or a relieved surface on the coring blade.

Figure 16:
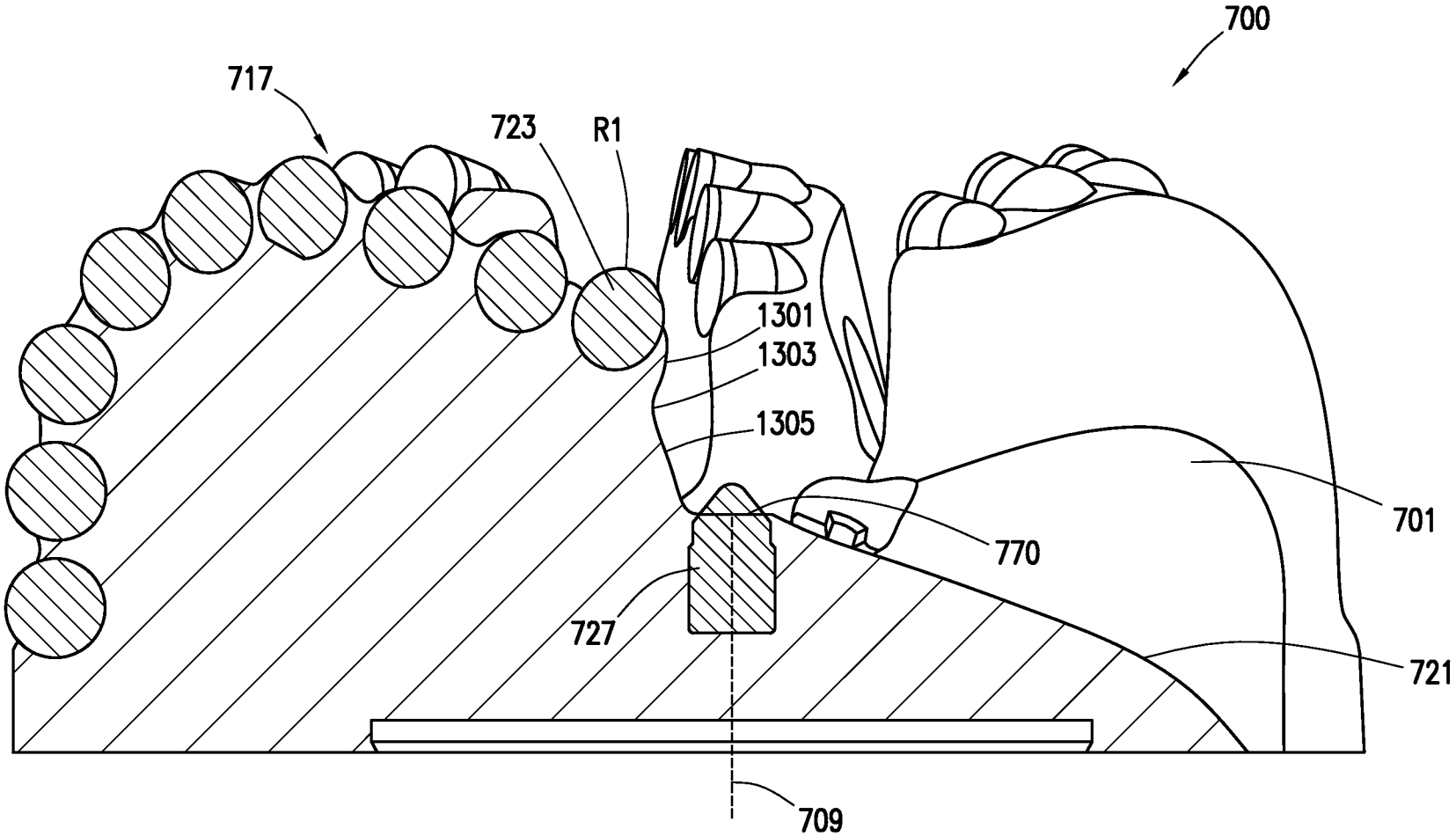
Figure 17:
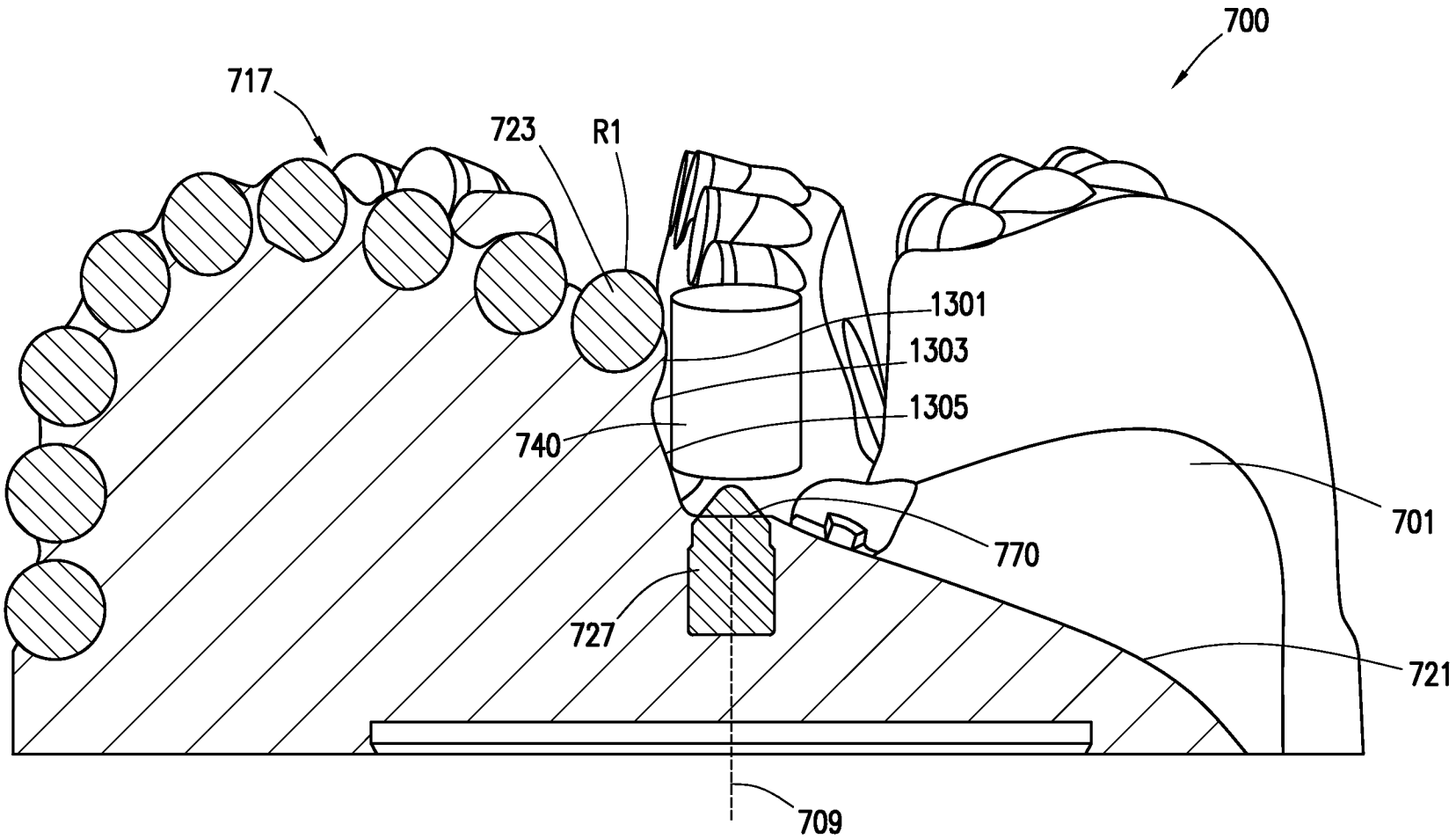

Referring back to FIG. 7, as well as to FIGS. 16-17, coring blade 717 may include substantially vertical surface 1301, relief 1303, and angled surface 1305. Angled surface 1305 is disposed axially above the blade top and axially below bit face 703, which extends through bit centerline 709. In some embodiments, bit face 703 may have an insert inserted into a hole therein, which may be on or proximate bit centerline 709. As shown, relief 1303 may be disposed between substantially vertical surface 1301 and angled surface 1305. Relief 1303 functions to relieve and protect substantially vertical surface 1301 from premature wear. According to one or more embodiments of the present disclosure, substantially vertical surface 1301, relief 1303, and angled surface 1305 are integrally connected to form a continuous piece, and are oriented to face bit centerline 709 of PDC bit 700.

According to other embodiments of the present disclosure, coring blade 717 may be configured without relief 1303. According to these other embodiments, substantially vertical surface 1301 and angled surface 1305 are integrally connected to form a continuous piece, and are oriented to face bit centerline 709 of PDC bit 700. Further, according to these other embodiments, substantially vertical surface 1301 and angled surface 1305 intersect at a point that is axially above first cutter 725 of coring blade 717.

According to one or more embodiments of the present disclosure, substantially vertical surface 1301 may be substantially parallel to bit centerline 709 of PDC bit 700. That is, according to one or more embodiments of the present disclosure, substantially vertical surface 1301 may be oriented such that substantially vertical surface 1301 is at an angle ranging from 0 to 5 degrees, in either direction, with respect to a line parallel to bit centerline 709 of PDC bit 700. As better shown in FIG. 17, the slope of angled surface 1305 helps determine the length of resulting core sample fragment 740. For example, the shallower the slope (i.e., the larger the degree of angle from bit centerline 709) of angled surface 1305, the longer the length of resulting core sample fragment 740. Likewise, the steeper the slope (i.e., the smaller the degree of angle from bit centerline 709) of angled surface 1305, the shorter the length of resulting core sample fragment 740. As understood by one of ordinary skill in the art, in addition to the slope of angled surface 1305, the height of coring blade 717 also helps determine the length of the resulting core sample fragment 740. For example, the taller the coring blade 717, the longer the length of resulting core sample fragment 740. Likewise, the shorter the coring blade 717, the shorter the length of resulting core sample fragment 740. Accordingly, as understood by one of ordinary skill in the art, angled surface 1305 may have an angle of various degrees from bit centerline 709, and coring blade 717 may have various heights in order to create core sample fragments 725 having various lengths without departing from the scope of the present disclosure. In a particular embodiment, angled surface 1305 may be disposed such that the axial point at which angled surface 1305 has a radial value equal to the radial position of the first coring cutting element 725 may have a lower limit of any of at least 0.1, 0.2, 0.3, 0.4, or 0.5 times the diameter of the bit, and an upper limit of any of 0.2, 0.3, 0.4, 0.5, 0.6, or 0.75 times the diameter of the bit, where any lower limit can be used in combination with any upper limit.

According to one or more embodiments of the present disclosure, angled surface 1305 has an angle in a range of 15 degrees to 20 degrees from bit centerline 709. However, in view of the above, this angle range is not intended to be limiting, and angled surface 1305 may have an angle of various degrees from bit centerline 709. For example, in one or more embodiments, angled surface 1305 may have a lower limit of any of about 5, 10, 15, 20, or 25 degrees, and an upper limit of any of 15, 20, 25, 30, 35, or 45 degrees. According to one or more embodiments of the present disclosure, angled surface 1305 may have any angle from bit centerline 709 that allows angled surface 1305 to exert a lateral load on a side of core sample fragment 740 that is sufficient to cause core sample fragment 740 to break away from formation after core sample fragment 740 reaches a desired length.

According to one or more embodiments of the present disclosure, relief 1303 may be disposed between substantially vertical surface 1301 and angled surface 1305. Relief 1303 functions to relieve and protect substantially vertical surface 1301 from premature wear. According to one or more embodiments of the present disclosure, the location of relief 1303 between substantially vertical surface 1301 and angled surface 1305 is based upon the desired length to width ratio of the resulting core sample fragment 740. According to one or more embodiments of the present disclosure, the ratio of the length of core sample fragment 740 to the width of core sample fragment 740 may be greater than or equal to one. As such, the location of relief 1303 is determined based on the height of the coring blade 717, the slope of angled surface 1305, and the location of radially interior portion of coring cutting element with respect to bit centerline 709, as previously described above. It is also within the scope of the present disclosure that any of the surfaces on coring blade 717 may be modified to include a low friction abrasion resistant material, such as thermally stable polycrystalline diamond (TSP), natural diamond, or any other type of thermally stable abrasion resistant material, which may include embedded pieces of such material on such surfaces.

Further, a center insert 727 (conical insert as illustrated, but other shaped cutting elements may be used) is disposed on or proximate bit centerline 709. As used herein, "proximate" with respect to bit centerline 709 means either on bit centerline 709 or between bit centerline 709 and coring cutting element 725. According to one or more embodiments of the present disclosure, conical insert 727 is embedded in bit body 701 such that an apex of conical insert 727 is positioned axially above relief 1303 of coring blade 717. In one or more embodiments, the center insert may have other geometric shapes (other than conical) and be substantially pointed (with a rounded apex). As shown, conical insert 727 is disposed on or proximate bit centerline 709 at a support surface 770 of bit body 701. According to one or more embodiments of the present disclosure, support surface 770 is disposed between coring blade 717 and evacuation slot 721 of PDC bit 700. According to one or more embodiments of the present disclosure, support surface 770 integrally connects coring blade 717 to evacuation slot 721 in a continuous piece. Further, according to one or more embodiments of the present disclosure, support surface 770 has a slope of less than 5 degrees, less than 3 or 2 degrees in other embodiments, or may even have a slope of zero with respect to bit centerline 709.

For example, an evacuation slot 721 may be included to aid in the evacuation of core samples from the bit. Evacuation slot 721 is shown positioned directly across bit centerline 709 relative to coring blade 717. According to one or more embodiments of the present disclosure, a profile of evacuation slot 721 is recessed below bit body 701 of PDC bit 700. As understood by one of ordinary skill in the art, the amount that evacuation slot 721 is recessed below bit body 701 may vary without departing from the scope of the present disclosure. For example, as appreciated by one of ordinary skill in the art, evacuation slot 721 may be recessed below bit body 701 by an amount that is sufficient to ensure a smooth exit of core sample fragment 740 from evacuation slot 721 in order to avoid bit plugging. Further, as appreciated by one of ordinary skill in the art, evacuation slot 721 may be recessed below bit body 701 by an amount that does not compromise the blank strength of PDC bit 700. Therefore, according to one or more embodiments of the present disclosure, evacuation slot 721 is recessed below bit body 701 of PDC bit 700 by an amount that allows smooth exit of core sample fragment 740 without bit plugging, and by an amount that does not adversely affect the service life of PDC bit 700. According to one or more embodiments of the present disclosure, evacuation slot 721 has a generally downward slope with respect to support surface 770 and bit body 701.

In one or more of the above described embodiments, the location of the coring cutting element(s) (the most radially interior cutting elements) on the bit may be described through the cutting edge thereof, in that the lowest axial point (remote from the pin) of the cutting edge of the at least one coring cutting elements is within the length of two times a cutting face diameter of a cutting element in the nose region of the bit (as that term is defined in FIG. 3 above) from such cutting element in the nose region of the bit. In more particular embodiments, the lowest axial point (remote from the pin) of the cutting edge of those coring cutting elements is within the length of a single cutting face diameter of a cutting element in the nose region of the bit from such cutting element in the nose region of the bit. Whether it is within 2× or 1× (or less) of the nose cutting element may depend, for example, on the shape of the blade. Another way to consider the location of the coring cutting elements is relative to the gage region of the bit. In one or more other embodiments, the lowest axial point (remote from the pin) of the cutting edge of those coring cutting elements is axially below the cutting elements in the gage region (as that term is defined in FIG. 3 above). In this manner, the shape of the blade and coring cutting elements are differentiated from the conventional coring bit.

As mentioned above, it is also within the scope of the present disclosure that any of the coring cutting elements may be selected from shear cutters (a diamond table disposed on a carbide substrate, which is brazed into a cutter pocket), rolling cutters (in having a cutting element that is free to rotate about its own axis), or non-planar cutting elements having a substantially pointed cutting surface (such as conical cutting elements, bullet shaped cutting elements or other cutting surface shapes).

Figure 18:
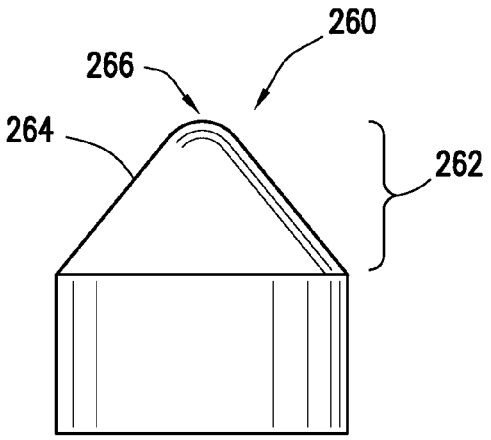
FIG. 18 shows a side view of a conical cutting element.
Figure 19:
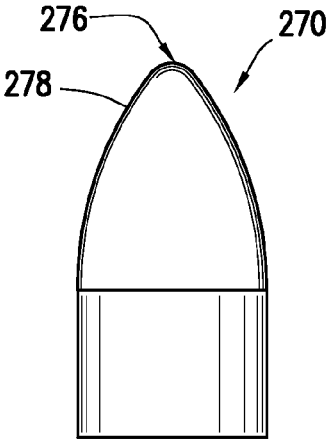
FIG. 19 shows a side view of a pointed cutting element having a convex side surface.
Figure 20:
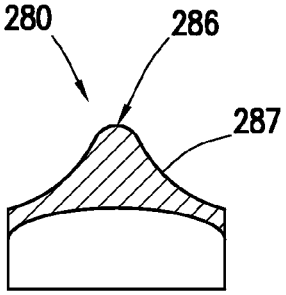
FIG. 20 shows a cross-sectional view of a pointed cutting element having a concave side surface.

For example, such non-planar cutting surfaces may include those cutting elements having a generally pointed cutting end, i.e., terminating in an apex, which may include cutting elements having a conical cutting end (shown in FIG. 18) or a bullet cutting element (shown in FIG. 19), for example. As used herein, the term "conical cutting elements" refers to cutting elements having a generally conical cutting end 262 (including either right cones or oblique cones), i.e., a conical side wall 264 that terminates in a rounded apex 266, as shown in FIG. 18. Unlike geometric cones that terminate at a sharp point apex, the conical cutting elements of the present disclosure possess an apex having curvature between the side surfaces and the apex. Further, in one or more embodiments, a bullet cutting element 270 may be used. The term "bullet cutting element" refers to cutting element having, instead of a generally conical side surface, a generally convex side surface 278 terminated in a rounded apex 276, as illustrated in FIG. 19. In one or more embodiments, the apex 276 has a substantially smaller radius of curvature than the convex side surface 278. However, it is also intended that the non-planar cutting elements 280 of the present disclosure may also include other shapes, including, for example, a concave side surface 287 terminating in a rounded apex 286, shown in FIG. 20. In each of such embodiments, the non-planar cutting elements may have a smooth transition between the side surface and the rounded apex (i.e., the side surface or side wall tangentially joins the curvature of the apex), but in some embodiments, a non-smooth transition may be present (i.e., the tangent of the side surface intersects the tangent of the apex at a non-180 degree angle, such as for example ranging from about 120 to less than 180 degrees). Further, in one or more embodiments, the non-planar cutting elements may include any shape having an cutting end extending above a grip or base region, where the cutting end extends a height that is at least 0.25 times the diameter of the cutting element, or at least 0.3, 0.4, 0.5 or 0.6 times the diameter in one or more other embodiments.

Although only a few example embodiments have been described in detail above, those skilled in the art will readily appreciate that many modifications are possible in the example embodiments without materially departing from this invention. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A fixed cutter drill bit, comprising:

a bit body having a bit centerline;

a plurality of blades extending radially from the bit body and separated by a plurality of flow courses therebetween, each of the plurality of blades being spaced a radial distance from the bit centerline to define a core-forming region, the core-forming region comprising a central portion of a bit face extending between the plurality blades;

a plurality of cutting elements disposed on the plurality of blades, the plurality of cutting elements comprising at least one coring cutting element disposed on at least one of the plurality of blades, the at least one coring cutting element being the radially innermost cutting element on the plurality of blades, the plurality of cutting elements defining a cutting profile when each of the plurality of cutting elements are combined into a single rotated view, wherein an inner cone angle of the at least one coring cutting element is defined as an angle in a plane of the cutting profile between the bit centerline and a tangential line that is tangential to outer tips of positions of the at least one coring cutting element and a radially adjacent cutting element that cuts the bottom hole in the cutting profile, the inner cone angle measured from the tangential line in a direction away from the position of the at least one coring cutting element, wherein a coring angle of the at least one coring cutting element is defined as an angle in the plane of the cutting profile between (i) a line within the bit body that is in the plane of the cutting profile and that is perpendicular to the bit centerline and (ii) a longitudinal axis of the at least one coring cutting element projected onto the plane of the cutting profile, when the at least one coring cutting element is rotated about the bit centerline until the tip of the at least one coring cutting element touches the tangential line, the coring angle measured from the axis of the at least one coring cutting element in a direction toward the bit centerline, and wherein the coring angle is less than the inner cone angle.

2. The fixed cutter drill bit of claim 1, wherein the coring angle is at least 50 percent of the inner cone angle.

3. The fixed cutter drill bit of claim 2, wherein the coring angle ranges between 65 and 80 percent of the inner cone angle.

4. The fixed cutter drill bit of claim 1, wherein the coring angle is at least 60 percent of the inner cone angle.

5. The fixed cutter drill bit of claim 1, wherein a back rake of the at least one coring cutting element ranges from −8 to −25 degrees.

6. The fixed cutter drill bit of claim 5, wherein the back rake of the at least one coring cutting element ranges from −10 to −20 degrees.

7. The fixed cutter drill bit of claim 1, wherein a side rake of the at least one coring cutting element is negative.

8. The fixed cutter drill bit of claim 1, wherein a side rake of the at least one coring cutting element ranges from −30 to 0.

9. The fixed cutter drill bit of claim 1, wherein the inner cone angle ranges from 55 degrees to less than 90 degrees.

10. The fixed cutter drill bit of claim 1, comprising at least two coring cutting elements, wherein one of the at least two coring cutting elements has a reduced axial exposure as compared to the others.

11. The fixed cutter drill bit of claim 1, wherein the plurality of cutting elements comprises at least two coring cutting elements.

12. The fixed cutter drill bit of claim 1, wherein the at least one coring cutting element has a non-planar cutting surface.

13. The fixed cutter drill bit of claim 1, wherein at least one of the plurality of cutting elements comprises a diamond impregnated insert.

14. The fixed cutter drill bit of claim 13, wherein the diamond impregnated insert is the radially adjacent cutting element.

15. The fixed cutter drill bit of claim 1, wherein the radially adjacent cutting element comprises a shear cutter.

16. The fixed cutter drill bit of claim 1, wherein the at least one coring cutting element is oriented such that its cutting edge is configured to cut at least a sidewall of a cylindrical core.

17. The fixed cutter drill bit of claim 1, wherein the at least one coring cutting element is oriented such that its cutting edge is configured to cut a sidewall of a cylindrical core and a bottom hole.

* * * * *